United States Patent [19]

Iwata et al.

[11] 4,416,556

[45] Nov. 22, 1983

[54] TYPE CARRIER FOR USE IN IMPACT-TYPE PRINTING MACHINES

[75] Inventors: Nobuo Iwata, Sagamihara; Koh Matsuhisa, Yokohama; Hiromi Takada, Yokohama; Takami Suzuki, Yokohama, all of Japan

[73] Assignee: Ricoh Company, Ltd., Japan

[21] Appl. No.: 314,507

[22] Filed: Oct. 23, 1981

[30] Foreign Application Priority Data

Jul. 20, 1981 [JP] Japan ..... 56-113200

[51] Int. Cl.[3] ..... B41J 1/30

[52] U.S. Cl. ..... 400/144.2; 400/174

[58] Field of Search ..... 400/144.2, 144.3, 174, 400/175

[56] References Cited

U.S. PATENT DOCUMENTS

| | | | |
|---|---|---|---|
| 3,921,277 | 11/1975 | Tramposch | 400/144.2 X |
| 3,954,163 | 5/1976 | Gabor | 400/144.2 |
| 4,126,400 | 11/1978 | Suzuki et al. | 400/144.2 |
| 4,127,336 | 11/1978 | Hiraoka et al. | 400/174 X |
| 4,335,970 | 6/1982 | Iwata et al. | 400/144.2 |

FOREIGN PATENT DOCUMENTS

| | | | |
|---|---|---|---|
| 1190506 | 5/1970 | United Kingdom | 400/174 |

OTHER PUBLICATIONS

*Xerox Disc. Journal*, by R. G. Crystal., vol. 1, Nos. 9/10, Sep./Oct. 1976, p. 21.

*Primary Examiner*—Paul T. Sewell

*Attorney, Agent, or Firm*—Guy W. Shoup; Eliot S. Gerber

[57] ABSTRACT

A type carrier for use in an impact-type printing machine to form an imprint of virtually the equal quality when used with either a flat hammer or a detentable, shaped hammer is provided. The present type carrier includes a hub and a plurality of fingers extending from the hub, each finger having a printing section which has a front surface provided with at least one type and a back surface having a novel structure. The back surface of the printing section includes at least one flat portion and at least a pair of sloped portions. Preferably, the sloped portions are defined such that they slope down oppositely from a plane common to or below the flat portion in the direction substantially perpendicular to the lengthwise direction of the finger.

14 Claims, 36 Drawing Figures

TYPE CARRIER FOR USE IN IMPACT-TYPE PRINTING MACHINES

BACKGROUND OF THE INVENTION

1. Field of the Invention

This invention relates to a type carrier for use in impact-type printing machines and more in particular to an improved type carrier having a plurality of types which may be selectively impacted by either a flat hammer or detentable hammer to produce an imprint of the virtually equal quality when used in an impact-type printing machine such as typewriters, line-printers and wordprocessors.

2. Background of the Invention

A type carrier which has a plurality of types and which is subjected to rotation with or without translation to bring the desired type into the printing position is well known. In such a type carrier, a plurality of types are usually arranged in a circle. Thus, when mounted in a printing machine, the type carrier is rotated to locate the desired type at the printing position and then the thus positioned type is impacted by a hammer to print a character on print paper. If a plurality of types are arranged in two or more circles, the type carrier is also subjected to a translational motion in positioning the desired type.

One prior art type carrier is illustratively shown in FIG. 1. The type carrier 1 shown in FIG. 1 is a disc-shaped type carrier, which is often referred to as a printing wheel and which includes a hub 2 provided with a center hole 2*a* through which a rotary shaft (not shown) is to be inserted. The printing wheel 1 also includes a plurality of fingers 3 which extend radially straight from the hub 2. Each of the fingers 3 is provided with a character pad 4, or printing section, at its tip end. A type is provided on the front surface of the printing section 4, the back surface of which presents as an impacting surface onto which a printing hammer (not shown) is to be impacted for forming an imprint.

Another prior art type carrier 1' is shown as mounted in printing arrangement in FIG. 2. The type carrier 1' is a cap-shaped type carrier which includes a hub 2 provided with a center hole 2*a* into which a rotary shaft 15 is fitted. The type carrier 1' also includes a plurality of fingers 3 which extend radially from the hub 2. As shown, the fingers 3 are at a certain angle with respect to the rotating axis of the shaft 15. At the end of each of the fingers 3 is provided with a printing section 4, or character pad, which is again angled against the corresponding finger 3. It should be noted, therefore, that the front and back surfaces of the printing sections 4 are generally in parallel with the rotating axis of the shaft 15 as different from the type carrier 1 of FIG. 1, in which the front and back surfaces of the printing sections 4 are generally perpendicular to the rotating axis. The finger 3 may serve as a connection between the printing section 4 and the hub 2.

In the example shown in FIG. 2, the type carrier 1' includes a pair of types 16*a* and 16*b* provided on the front surface of each of the printing sections 4 spaced apart from each other. Thus, the types 16*a* form a first circle of type arrangement; whereas, the types 16*b* form a second circle of type arrangement. Disposed inside the type carrier 1' is an impact device 18 which includes a reciprocatingly movable hammer 15. On the other hand, printpaper 19 is passed around a platen 20, and an ink ribbon 21 is disposed between the type carrier 1' and the platen 20, passing through the printing section.

In operation, the type carrier 1' is rotated with or without translational movement along the rotating axis to locate the desired type at the printing position. Then, the hammer 15 is advanced to press the desired type against the print paper 19 with the ink ribbon 21 inbetween, thereby forming an imprint of the desired type on the print paper 19. It should thus be understood that the fingers 3 possess a certain degree of elastisity.

FIG. 3 shows another conventional disc-shaped type carrier 1'' which includes a single type 16*a* or 16*b* on the front surface of each of the printing sections. A pair of type carriers 1'', 1'' is fixedly mounted on a common rotary shaft 23. The operation of this arrangement is similar to that of FIG. 2 except the impacting process. That is, in the arrangement of FIG. 3, after locating the desired type at the printing position, the shaft 23 is inclined in the direction indicated by the arrow A so that a flange 24 is brought into engagement with a stopper 25, which, in turn, will cause a hammer 15 to press the desired type against the platen 20, thereby forming an imprint on the print paper 19.

FIGS. 4(A) and (B) show several structures of the printing section, particularly its back surface, of the fingers used in prior art type carriers as shown in FIGS. 1 through 3. FIG. 4(A) shows a non-detentable structure; whereas, FIG. 4(B) shows a detentable structure.

FIG. 4(A) shows a non-detentable combination which includes the printing section 4*a* having a flat back surface 26*a* and the hammer 15*a* having a flat impact surface 27*a*. The printing section 4*a* includes a type 16 on its front surface. Thus, when the hammer 15*a* is advanced in the direction indicated by the arrow B, the impact surface 27*a* comes into contact with the flat back surface of the printing section 4*a*, thereby deflecting the supporting finger 3 to press the type 16 against the platen (not shown). With such a combination, the impacting force may be uniformly applied to the type; however, there is a chance of causing misalignment or smearing of the printed character if the hammer 15*a* presses the printing section 4*a* while it is still in vibration, such as in high-speed printing operation.

FIG. 4(B) shows a detentable combination which includes the printing section 4*b* having a triangular prism member 26*b* and the hammer 15*b* having a recessed impacting surface 27*b* in the shaped of "V." The V-shaped recess 27*b'* has two sloped surfaces which are engageable with the two sloped side surfaces of the prism member 26*b*, which is provided to project from the back surface 26*a* of the printing section 4*b*. In this case, when the hammer 15*b* is moved toward the printing section 4*b* as indicated by the arrow B to bring the V-shaped recess 27*b'* into engagement with the prism member 26*b*, the printing section 4*b* is forcibly brought into the aligned position so that the probability of misalignment may be precluded. However, such a structure requires the use of a specially shaped hammer and it is disadvantageous since limitations are imposed upon the variety in using replaceable type carriers.

SUMMARY OF THE INVENTION

The disadvantages of the prior art are overcome with the present invention which proposes to provide an improved type carrier usable both with a flat hammer and a shaped hammer to provide an imprint of the substantially equal quality.

The present invention has been made on the recognition of the fact that, in general, type carriers are replaceable parts of a printing system while impacting hammers are not. In reality, some existing printing systems are equipped with flat hammers, and some are equipped with shaped hammers. Besides, a non-detentable structure with a flat hammer has merits and demerits, so does a detentable structure with a shaped hammer. Accordingly, it is most appropriate if there exists a type carrier which is usable not only with a flat hammer, but also with a shaped hammer with virtually the same imprinting performance. The present invention has been proposed to satisfy such needs, not to mention of improving the imprinting quality itself such as excellence in alignment and resolution.

It is true, as shown in FIG. 5, that a type carrier which has a mesa member 26*c* on the back surface 26*a* of each of the fingers 3 may be commonly used with flat and shaped hammers. As shown, if use is made of a shaped hammer 15*c* having a printing surface 27*c* shaped in the form of a trapezoidal recess 27*c'*, alignment of printed characters may be improved. However, because of the shape of a mesa, the top flat surface 26*c'* is reduced in size, in particular its width, and, therefore, uniformity in distribution of the impacting force on the type 16 when in press contact with the print paper may be sacrificed to some extent. This tendency is particularly true when the type 16' represents a character asymmetric in structure, as shown in FIG. 6.

The advantages of the present invention are preferably attained by providing a type carrier for use in a printing machine, in which said type carrier is rotatably supported and driven to rotate to bring a desired type into a printing position where said desired type is impacted by a hammer to make an imprint, wherein said type carrier comprises a hub and a plurality of fingers extending generally radially from said hub, each of said fingers including a printing section, said printing section including at least one type on its front surface, the back surface of said printing section being formed by at least one flat portion and at least a pair of sloped portions which slope down oppositely from a plane common to or below said flat portion in the direction substantially perpendicular to the lengthwise direction of said each finger. The structure of the present invention is particularly advantageous and presents improvements over the prior art by providing a novel structure on the back surface of a printing section.

In accordance with the present invention, a part of the back surface of the printing section is used to form a flat portion so that it is now possible to provide a widest possible flat area at the back surface of the printing section. In one example, the flat portion of the present invention may be as wide as the back surface of the printing section itself. Such a structure is particularly useful in imprinting an asymmetrical character because an impact force may be applied more uniformly. Moreover, since the type carrier of the present invention also includes a pair of sloped portions which slope down oppositely from a plane common to or below the flat portion in the direction substantially perpendicular to the lengthwise direction of the supporting finger, the present type carrier may be used with a shaped hammer having a detentable structure which mates with the pair of sloped portions.

It is therefore an object of the present invention to provide a type carrier which is capable of producing an imprint of excellent quality.

Another object of the present invention is to provide a type carrier which may be employed either with a flat hammer or with a shaped hammer.

A further object of the present invention is to provide a type carrier which is capable of presenting a widest possible flat surface portion, thereby distributing an impact force uniformly.

A still further object of the present invention is to provide a type carrier which is relatively simple in structure and, therefore, easy to manufacture.

A still further object of the present invention is to provide a type carrier which has a prolonged service life.

These and other objects of the present invention will become more apparent when reference is made to the following detailed description of the invention together with the accompanying drawings.

DESCRIPTION OF PREFERRED EMBODIMENTS

Figure 1:
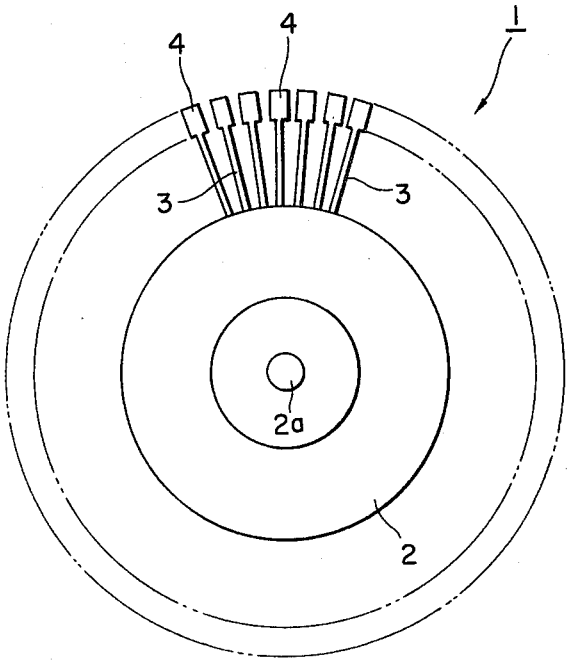
FIG. 1 PRIOR ART
FIG. 1 is a schematic illustration showing the general structure of a prior art disc-shaped type carrier.
Figure 2:
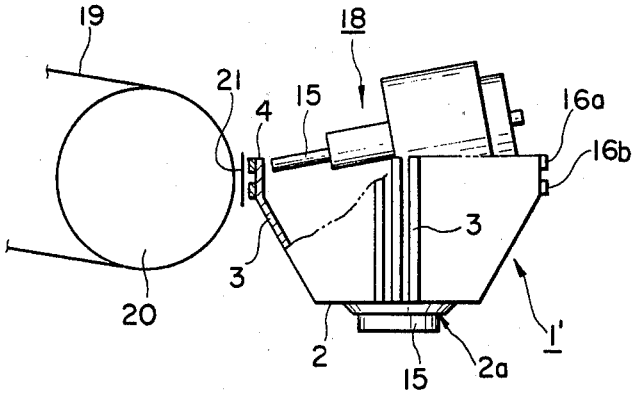
FIG. 2 PRIOR ART
FIG. 2 is a schematic illustration showing a prior art cup-shaped type carrier as mounted in a printing system.
Figure 3:
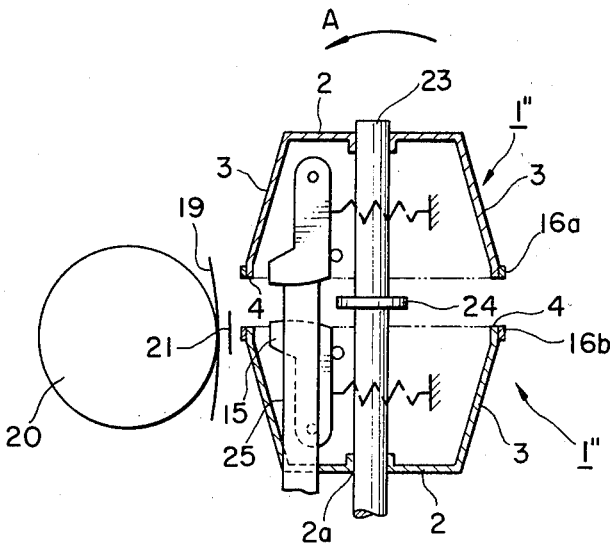
FIG. 3 PRIOR ART
FIG. 3 is a schematic illustration showing another prior art cup-shaped type carrier as mounted in a printing system.
Figure 4A:
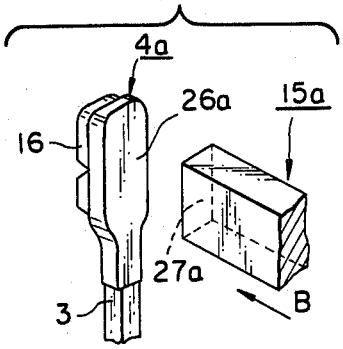
FIG. 4A PRIOR ART
FIG. 4(A) shows a prior art non-detentable structure.
Figure 4B:
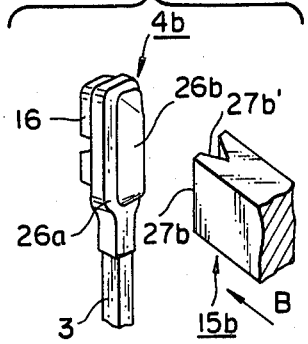
FIG. 4B PRIOR ART
FIG 4(B) shows a prior art detentable structure.
Figure 5:
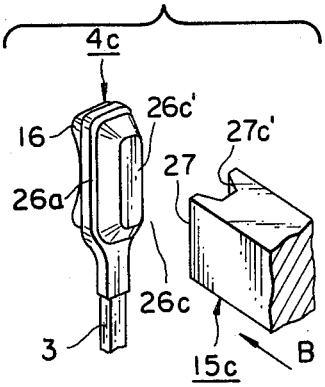
FIG. 5 shows a modified detentable structure in which either of flat and shaped hammers may be used.
Figure 6:
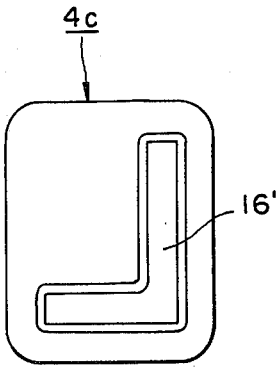
FIG. 6 is a front view of the front surface of the printing section having a type representing the letter "L"
Figure 7:
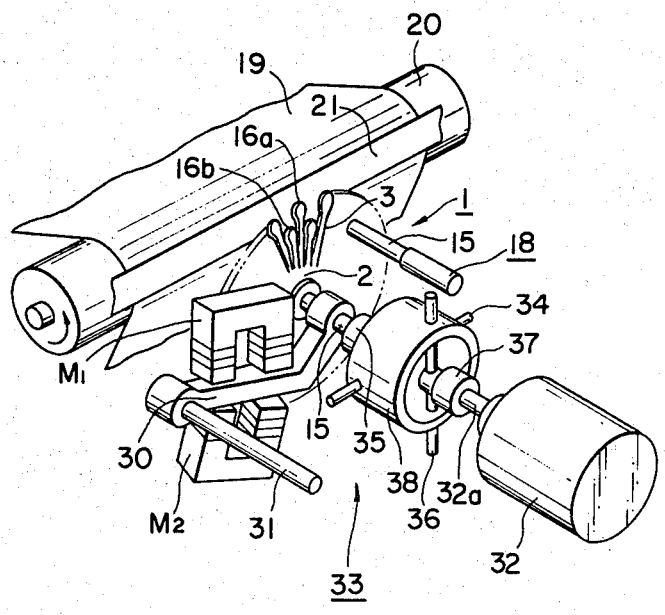
FIG. 7 is a schematic illustration showing an exemplifying printing machine to which the present type carrier may be applied.

Referring now to FIG. 7 which shows the main structure of a printing machine to which the present type carrier 1 may be applied. As shown, the disc-shaped type carrier 1 comprises two groups of types differently located from the rotating axis of the rotary shaft 15. One group is comprised of types 16*a* which are located farther from the rotating axis than the other group comprised of types 16*b*. Such being the case, the carrier 1 must be subjected to translational motion as well as rotation in bringing the desired type into the printing position predetermined in the printing machine.

The rotary shaft 15 is rotatably supported by an arm 30 which may be pivoted around a supporting shaft 31 by selective energization of electromagnets M1 and M2. For example, when the electromagnet M1 is energized, the rotary shaft 15 is moved upward thereby allowing to bring one of the types 16*b* into the printing position; on the other hand, when the electromagnet M2 is energized, the rotary shaft 15 is moved downward thereby allowing to bring one of the types 16*a* into the printing position. The rotary shaft 15 is also subjected to rotation as driven by a motor 32. However, since the rotary shaft 15 is moved up and down, a special coupling 33 is provided between the rotary shaft 15 and the driving shaft 32*a* of the motor 32. More in detail, the rotary shaft 15 is connected to a first rod 34 through a first connector 35 as a unit, and the driving shaft 32*a* is connected to a second rod 36 through a second connector 37 as a unit. The first and second rods 34, 36 are slidably inserted into holes provided in a cylinder 38 so that they extend perpendicular to each other. With such a structure, the rotational driving force of the driving shaft 32*a* may be properly transferred to the rotary shaft 15 through the coupling 33 even when the rotary shaft 15 is moved up and down.

Figure 8A:
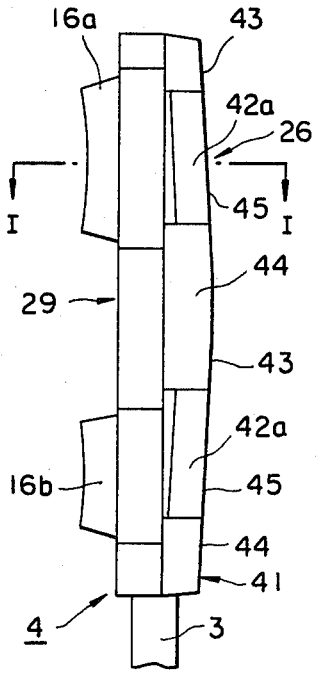
FIGS. 8(A) and (B) show on an enlarged scale the detailed structure of the printing section of the type carrier embodying the present invention.

FIGS. 8(A) and (B) show the detailed structure of the printing section 4 of the type carrier in accordance with one embodiment of the present invention. As shown, the printing section 4 is formed along the lengthwise direction of the finger 3 and it has two types 16*a* and 16*b* on the front surface 29. It is to be noted that the front surface may be provided with a single type. The back surface 26 of the printing section 4 includes a pair of impacting zones 40*a* and 40*b* defined in registry with the pair of types 16*a* and 16*b*, respectively. Each of the impacting zones 40*a* and 40*b* is comprised of a flat portion 41 and a pair of sloped portions 42*a* and 42*b* which slope down oppositely from the flat portion 41 in the direction substantially perpendicular to the lengthwise direction of the finger 3. The flat portions 41, 41 of the zones 40*a* and 40*b*, respectively, are inclined in opposite directions, as best shown in FIG. 8(A). This will ensure proper surface contact between the printing section 4 and its associated hammer even though there are differences in amount of deflection between the two types 16*a* and 16*b*.

Figure 8B:
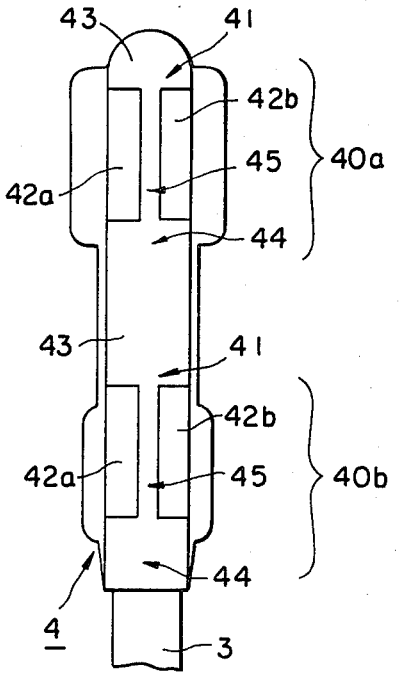

The flat portion 41 of each of the impacting zones 40*a* and 40*b* comprises a top flat area 43, a bottom flat area 44 and an intermediate flat area 45. The top flat area 43 is located near the top of the type 16 and the bottom flat area 44 is located near the bottom of the type 16. Preferably, as best shown in FIG. 8(B), the top and bottom flat areas 43 and 44 have a width which substantially corresponds to the width of the back surface 26 or the printing section 4 and the intermediate flat area 45 has a narrowed width which is relatively narrower than the width of the top and bottom flat areas 43, 45, whereby the pair of sloped portions 42*a* and 42*b* are defined to slope down from the sides of the intermediate flat area 45, respectively, in opposite directions.

It is to be noted that the finger 3 is sufficiently flexible so that the printing section 4 is shiftable with respect to the hub 2 at least when impacted by the hammer 15. It is also to be noted that the printing section 4 may be made of the same material as the finger 3, but the printing section 4 should be made substantially harder than the finger 3, for example, by the addition of hardening agent or reinforcing elements.

Figure 9A:
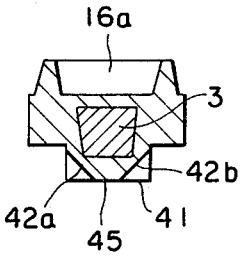
FIGS. 9(A) and (B) are cross-sectional views taken along the line I—I in FIG. 8(A)
Figure 9B:
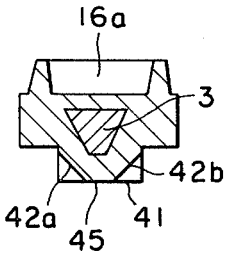

One particularly useful structure in forming the printing section 4 and the finger 3 is a double mold structure, in which the finger 3 is formed by a first mold and the printing section 4 is formed by a second mold at least partly enclosing the first mold. Such a structure may be discernible from FIGS. 9(A) and (B) and also from FIGS. 24(A) and (B). In such a structure, it is preferable that the first mold is relatively elastic; whereas, the second mold is substantially hard. Preferably, use may be made of a thermoplastic resin for the first mold and a thermosetting resin for the second mold. Reinforcing elements such as glass fibers may be added appropriately. In one example, the first mold is comprised of 6–6 Nylon and glass fibers of 30–33% by weight and the second mold is comprised of a phenol resin and glass fibers of about 60% by weight.

Figure 10A:
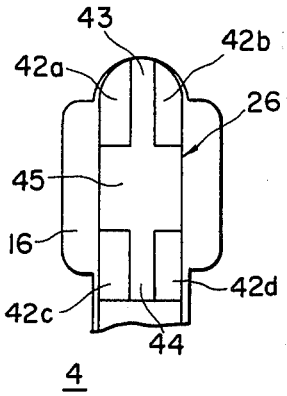
FIGS. 10(A) through (D) show alternative embodiments of the present invention.
Figure 10B:
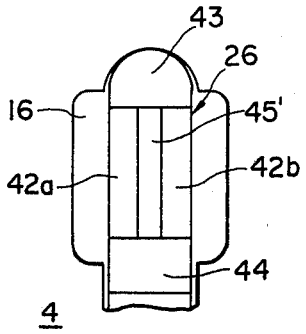

FIGS. 10(A) through (D) show several modified structures of the back surface 26 of the printing section 4 in accordance with the present invention. FIG. 10(A) is the case where the intermediate flat area 45 has a width which substantially corresponds to the width of the back surface 26 or the printing section 4, and the top and bottom flat areas 43, 44 have a narrowed width which is relatively narrower than the width of the intermediate flat area, whereby two pairs of sloped portions, i.e., 42*a*–42*b* and 42*c*–42*d*, are provided to slope down from the sides of the top and bottom flat areas 43, 44, rrespectively. FIG. 10(B) shows another embodiment in which the intermediate flat area 45' having a narrowed width is recessed so that the plane defined by the intermediate flat area 45' is located lower than the plane defined by the top and bottom flat areas 43 and 44. With such a structure, the recessed intermediate flat area 45' may be prevented from being impacted by a hammer.

Figure 10C:
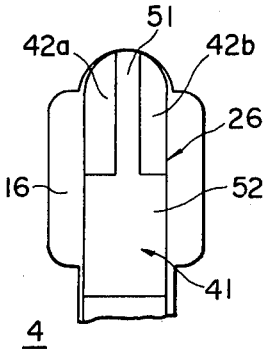
Figure 10D:
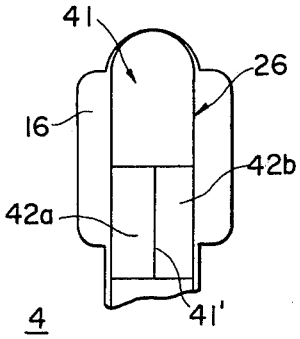

FIG. 10(C) shows an embodiment in which the back surface 26 includes a flat portion 41 comprised of an upper flat area 51 defined to cover approximately the top half of the type 16 provided on the front surface of the printing section 4 and a lower flat area 52 defined to cover approximately the bottom half of the type 16, whereby the lower flat area 52 has a wide width substantially corresponding to the width of the back surface 26 or the printing section 4 and the upper flat area 51 has a narrowed width relatively narrower than the wide width with the pair of sloped portions 42*a* and 42*b* sloping down from the sides of the upper flat area 51 oppositely in the direction substantially perpendicular to the lengthwise direction of the printing section 4, or the finger 3. On the other hand, FIG. 10(D) shows the case in which the upper flat area has a wide width extending substantially the width of the back surface 26 or the printing section 4 and the bottom flat area is shrinked to a ridge 41′ from which the pair of sloped portions 42*a* and 42*b* slope down in opposite directions.

Figure 11A:
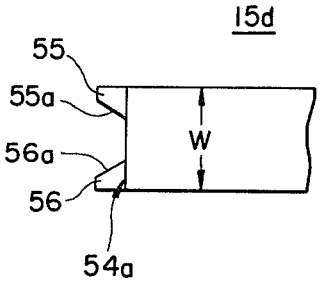
FIGS. 11(A) and (B) show the structure of a detentable hammer which may be used with the present type carrier.
Figure 11A:
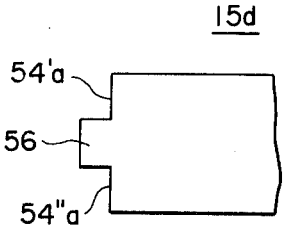

Shown in FIGS. 11(A) and (B) is a printing hammer 15*d* which may be used with such a type carrier as shown in FIGS. 8(A) and (B). The hammer 15*d* has an impacting surface 54*a* and a pair of projections 55 and 56 projecting from the impacting surface 54*a* in the forward direction. These projections 55 and 56 have sloped mating surfaces 55*a* and 56*a*, respectively, which are defined to be complementary to the sloped portions 42*a* and 42*b* of the printing section 4. Therefore, the sloped portions 42*a* and 42*b* of the printing section 4 and the mating surfaces 55*a* and 56*a* of the hammer 15*d* form an alignment mechanism in which the printing section 4 or the type 16*a* or 16*b* is forcibly brought into the position of alignment even if it is initially out of alignment as the hammer 15*d* moves forward.

It should be appreciated that the hammer 15*d* has a relatively wider impacting surface 54*a* as compared with the prior art. Most significantly, the upper impacting portion 54*a*′ and the lower impacting portion 54*a*″ extend the full width W of the hammer 15*d*. Therefore, the impacting surface 54*a* of the hammer 15*d* may contact with the back surface 26 of the printing section 4 with the widest possible width as well as an increased contact area so that the impacting force applied by the hammer 15*d* may be more uniformly distributed over the whole type 16, resulting in producing an imprint of excellent quality and preventing the type 16, especially of the asymmetric structure, from being broken or partially worn out. It will thus be understood that the present type carrier allows to apply virtually the same distribution of the impacting force on the type irrespective of whether a flat hammer or shaped detentable hammer is used.

Moreover, the alignment capability is increased in the present invention due to the shrinked size of the aligning projections 55 and 56. Since the projections 55 and 56 are shorter, they may be brought into contact with the sloped portions 42*a* and 42*b* of the printing section 4 more easily. The hammer 15*d* is shown in perspective in FIG. 18.

Figure 13:
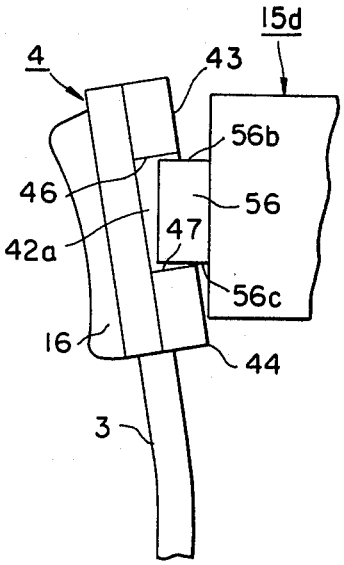
FIG. 13 is a schematic illustration showing the relationship between the present type carrier and the associated detentable hammer when they are in engagement.
Figure 12:
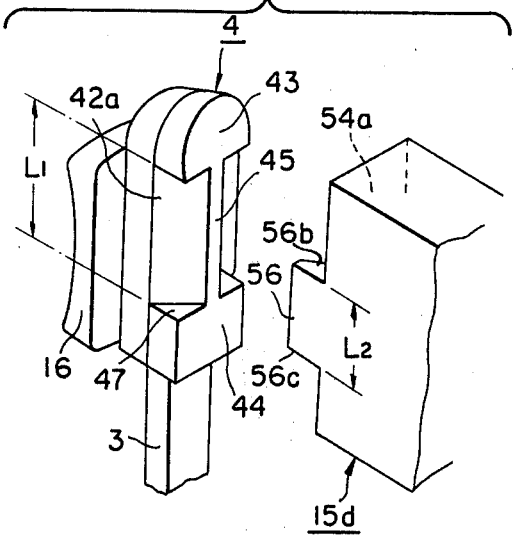
FIG. 12 is a schematic illustration showing the operative relationship between the present type carrier and the associated detentable hammer when they are apart.

FIG. 12 shows the operative relationship between the printing section 4 and the hammer 15*d*. It is to be noted that the aligning projections 55 and 56 have the length $L_2$ which is reasonably shorter than the length $L_1$ of the intermediate flat area 45 or the sloped portions 42*a* and 42*b*. The amount of difference in these lengths $L_1$ and $L_2$ should be appropriately determined in view of the amount of the deflection of the finger 3 when impacted by the hammer 15*d*. In other words, if $L_1$ and $L_2$ are comparable in size, then the projections 55 and 56 of the hammer 15*d* will exert unacceptable force on the printing section 4 when it is moved along the path of an arc as the finger 3 deflects due to the forward movement of the hammer 15*d* as best shown in FIG. 13. Under such circumstances, the printing section 4 forms cracks due to stress concentration, which could lead to breakage in extreme cases, and/or it will be partly scraped or worn out because of excessive rubbing action.

Figure 14:
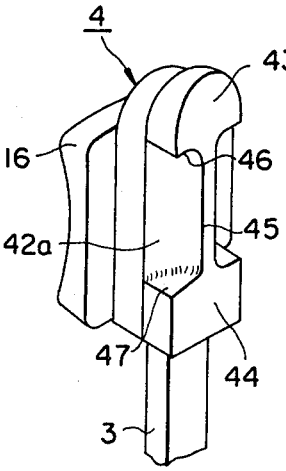
FIG. 14 is an oblique view showing a further embodiment of the present invention.
Figure 15:
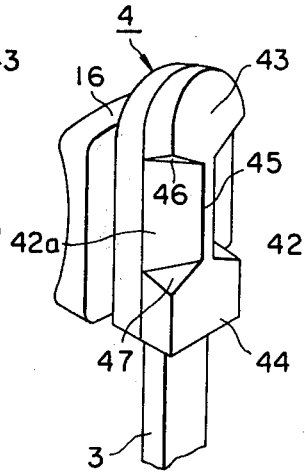
FIG. 15 is an oblique view showing a still further embodiment of the present invention.
Figure 16:
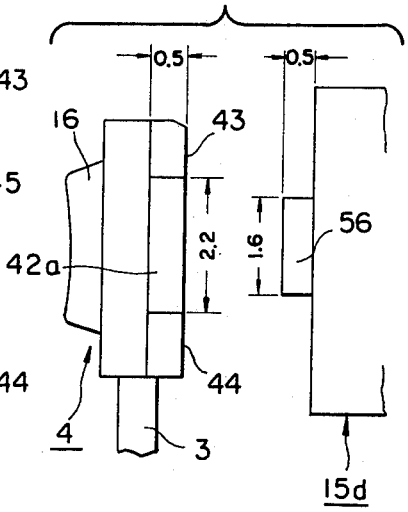
FIG. 16 is a schematic illustration showing a typical size relationship between the printing section and the hammer.

Setting $L_1$ and $L_2$ such that $L_1$ is reasonably larger than $L_2$ in view of the amount of deflection of the finger 3 can avoid the above-described problems. Furthermore, it is preferable to provide a rounded corner between the sloped portion 42*a* or 42*b* and end surfaces 46 and 47, as shown in FIG. 14. Alternatively, inclined end surfaces 46 and 47 may be provided as shown in FIG. 15. These structures are useful in avoiding generation of stress concentration when the printing section 4 is impacted by the hammer 15*d*, thereby enabling to further prolong the service life of the present type carrier 1. FIG. 16 illustrates one specific example showing relative dimensions in mm between $L_1$ and $L_2$.

Figure 17:
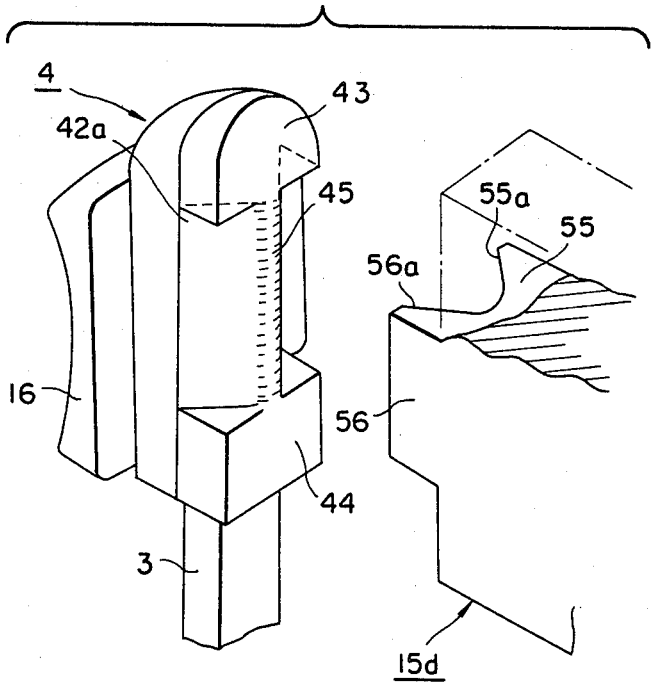
FIG. 17 is a schematic illustration showing a still further embodiment of the present type carrier and its associated detentable hammer.

FIG. 17 shows another modification in reducing the possibility of causing stress concentration. As shown, the edges formed between the intermediate flat area 45 and the sloped portions 42*a* and 42*b* are appropriately rounded. It is also preferable that the inner surfaces 55*a* and 56*a* of the aligning projections 55 and 56 form a correspondingly rounded surface.

Figure 18:
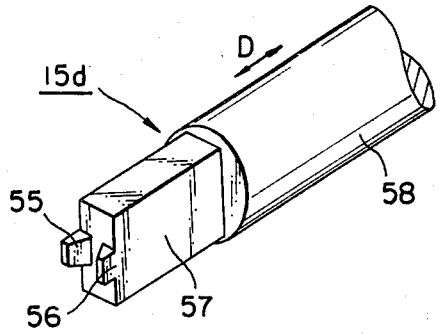
FIG. 18 is a perspective view showing the structure of a detentable hammer which may be used with the present type carrier.

FIG. 18 shows the structure of a typical detentable hammer 15*d* which may be used with the present type carrier 1. As shown, the hammer 15*d* comprises a rectangular forward portion 57 and a column-like base portion 58, which is slidably housed in a cylinder (not shown). The hammer 15*d* is guided to move reciprocatingly in the direction indicated by the double-pointed arrow D and it is restrained from being rotated. However, in order to assure a smooth reciprocating motion, a certain degree of play is necessary. The provision of such a play then allows the hammer 15*d* to rotate around the center axis of the base portion 58 over a certain angle. Under the circumstances, there is a possibility that the sharp edges and/or corners of the aligning projections 55 and 56 of the hammer 15*d* hit and crack the intermediate flat area 45 of the printing section 4.

Figure 19:
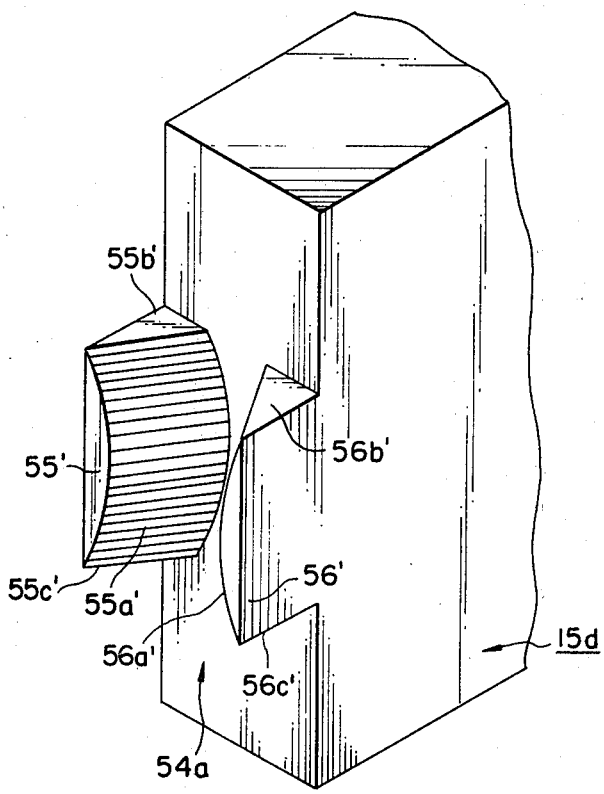
FIG. 19 is a perspective view showing on an enlarged scale a modified detentable hammer.
Figure 20:
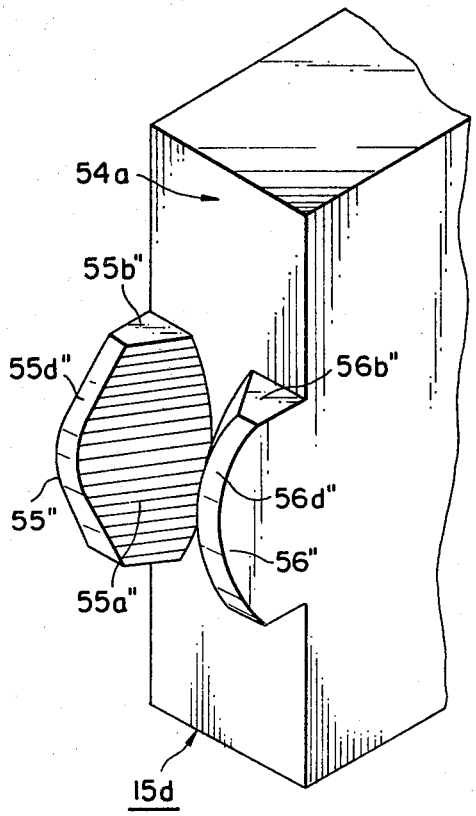
FIG. 20 is a perspective view showing on an enlarged scale another modified detentable hammer.
Figure 22:
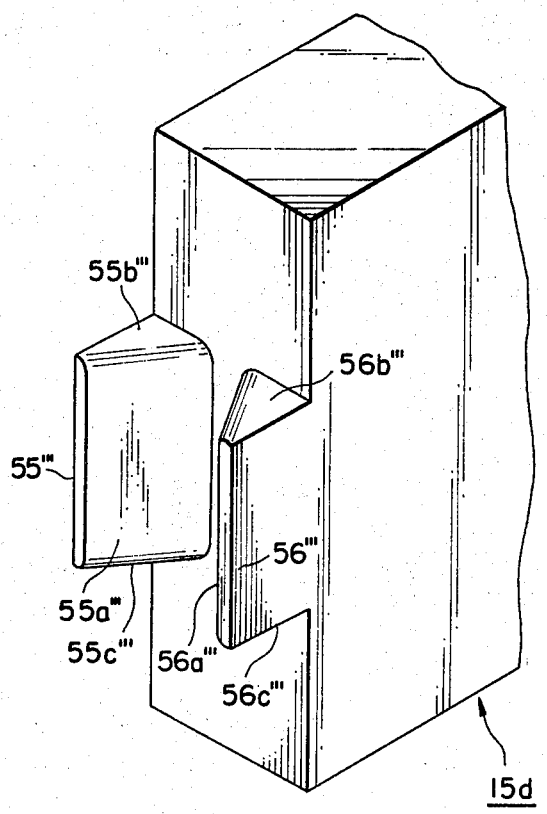
FIG. 22 is a perspective view showing on an enlarged scale a further modified detentable hammer.

FIGS. 19, 20 and 22 show several embodiments of the modified hammer 15*d* which is capable of avoiding the possibility of cracking the back surface 26 of the printing section 4. FIG. 19 shows an embodiment in which the aligning projections 55′ and 56′ are each formed by a portion of a truncated cone. Thus, the inner surfaces 55*a*′ and 56*a*′ each present a curved surface, and the distance between the two inner surfaces 55*a*′ and 56*a*′ is the longest at the top 55*b*′ (56*b*′) and the bottom 55*c*′ (56*c*′) of the projection 55′ (56′) and the shortest at the midpoint between the top and the bottom. Preferably, such the shortest distance is the same as the width of the intermediate flat area 45.

With the use of such a hammer 15*d* shown in FIG. 19, the possibility of the sharp edges and corners of the projections 55′ and 56′ comming into contact with the back surface 26 of the printing section 4 is significantly reduced. Besides, even though the hammer 15*d* is rotated over the degree of the play at the time of impacting operation, the printing section 4 will not be inclined with respect to the lengthwise direction of the finger 3 so that occurrence of misalignment in the printed character due to the small rotation of the hammer 15*d* may be effectively eliminated.

FIG. 20 shows a further modification of the detentable hammer 15*d*. As shown, the hammer 15*d* of FIG. 20 includes aligning projections 55″ and 56″ provided with curved front ends 55*d*″ and 56*d*″, respectively. With such a structure, sharp corners will not contact the back surface 26 of the printing section 4.

FIG. 22 shows a still further modification of the detentable hammer 15*d*. Similarly with the other cases, a pair of aligning projections 55‴ and 56‴ is provided partly along the vertical sides of the front end of the hammer 15*d*, thereby providing a larger impacting surface. As shown in FIG. 22, the edges formed between the inner inclined surface 55*a*‴ or 56*a*‴ and either of the top and bottom surfaces 55*b*‴, 55*c*‴ or either of the top and bottom surfaces 56*b*‴, 56*c*‴, respectively, are rounded. These rounded edges will significantly reduce the possibility of damaging the printing section 4 in impacting operation.

Figure 21:
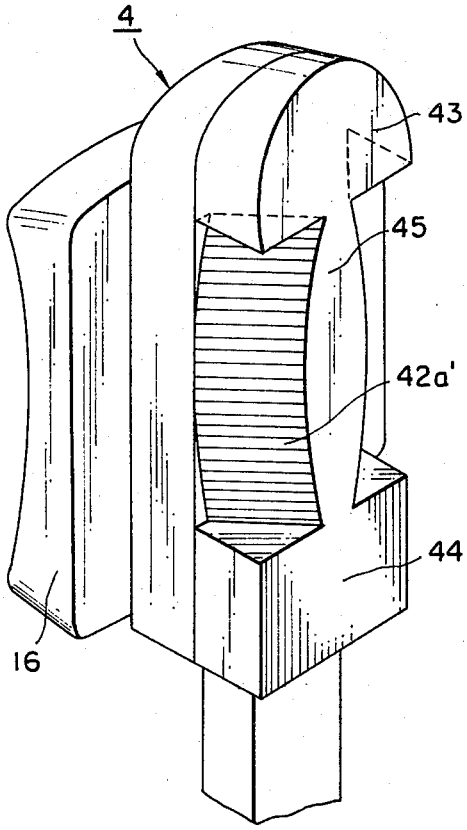
FIG. 21 is a perspective view showing on an enlarged scale a still further embodiment of the present type carrier, having a curved sloped portions.

On the other hand, the printing section 4 may be modified to prevent the sharp corners or edges of the hammer 15*d* from comming into direct contact. One such example is shown in FIG. 21, where the printing section 4 is provided with the curved, sloped portion 42*a*′. The other sloped portion should be similarly curved in symmetry. If desired, the edge between the flat area 45 and the curved, sloped portion 42*a*′ may be rounded. The printing section 4 having the structure shown in FIG. 21 is less likely to be damaged even if it is used with the hammer 15*d* having sharp corners and edges as shown in FIG. 18.

Now, description will be made with reference to FIGS. 23 and 24. As described previously, the finger 3 should be sufficiently elastic so that the printing section 4 may shift with respect to the hub of the type carrier 1, which is usually fixedly mounted on the rotary shaft 15, during the impacting operation. On the other hand, the printing section 4 should be substantially hard because it constitutes a base for supporting types thereon and it is directly impacted by the hammer. Under such circumstances, it is preferable to form the type carrier 1 in a double mold structure, i.e., forming the finger 3 by a first mold to provide the required elasticity and then forming the printing section 4 around a part of the finger 3 by a second mold which is substantially hard as required.

Figure 23A:
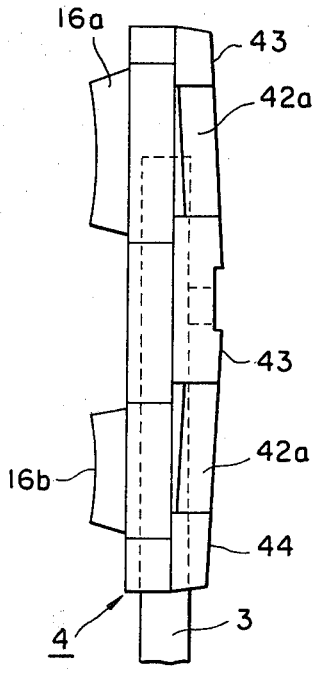
FIGS. 23(A) and (B) show a still further embodiment of the present type carrier.
Figure 23B:
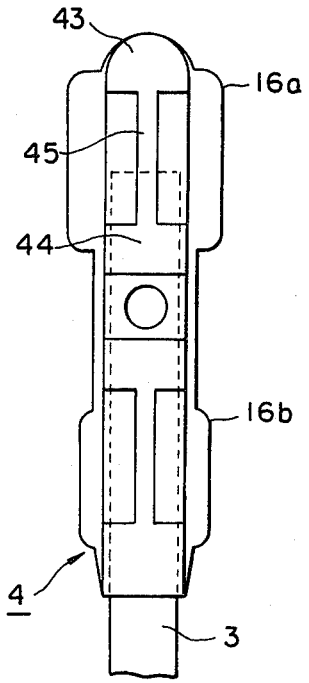

FIGS. 23(A) and (B) show one example of the double mold structure. The finger 3 extends substantially inside of the printing section 4 and its tip end is located near the center of the upper type 16*a*. Since the printing section 4 is formed by injection molding after the formation of the finger 3, it is preferable to have such extended buried length in order to improve the degree of integration between the finger 3 and the printing section 4. It should, however, be noted that the end of the finger 3 is located in the impacting region for the type 16*a* and this might cause cracks in that part of the printing section 4 due to possibly increased stress concentration around the end of the finger 3.

Figure 24A:
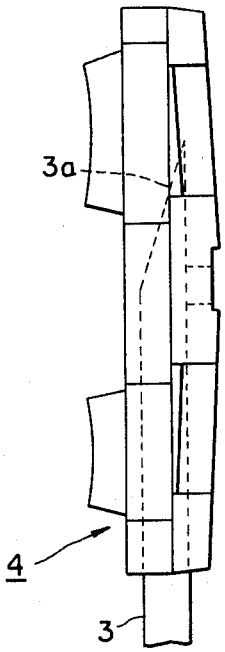
FIGS. 24(A) and (B) show a still further embodiment of the present type carrier.
Figure 24B:
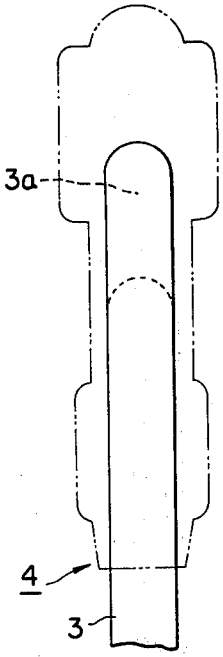

Accordingly, the end of the finger 3 had better be located outside of the impacting region, but this idea may not be feasible at all times from various other reasons. Thus, in the event that it cannot help but to locate the end of the finger 3 in the impacting zone, it is preferable to form the end portion of the finger 3 such that its cross-sectional area decreases toward the tip end gradually and continuously. One such example is shown in FIGS. 24(A) and (B) where a taper 3*a* is provided. It is to be noted that two or more tapers may be provided. Alternatively, the end portion of the finger 3 may be formed in the form of a cone to attain the desired effects.

Figure 25:
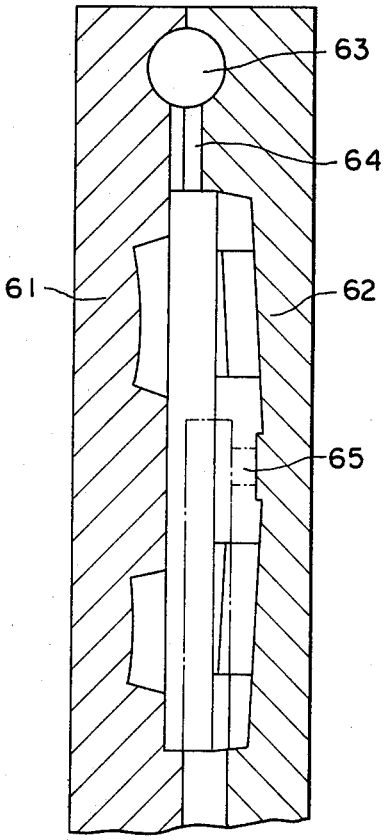
FIG. 25 is a fragmentary cross-sectional view showing two mold halves in contact to define a mold cavity therebetween.
Figure 26:
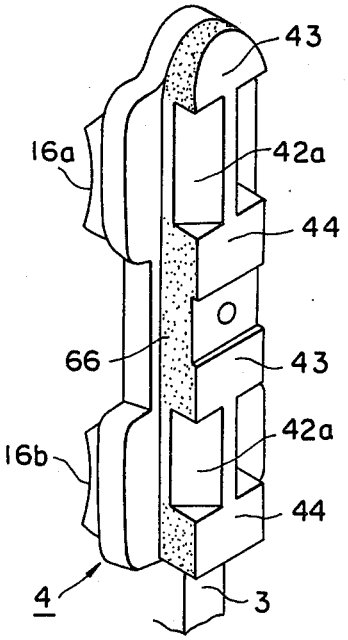
FIG. 26 is a perspective view showing a still further embodiment of the present type carrier.

Now, description will be had as to a method of manufacturing the present type carriers 1 and type carriers 1 having a preferred structure in manufacturing the same with particular reference to FIGS. 25 and 26.

FIG. 25 shows in cross-section a pair of mold halves 61 and 62 which are in contact to form a mold cavity in-between. When manufacturing the present type carriers 1 in double mold structure, the fingers 3 are first formed together with the hub 2 from which the fingers 3 extend radially. The thus formed first mold comprised of the hub 2 and the fingers 3 is then placed in the mold recess of one of the mold halves, e.g., mold half 62. Then, the other mold half 61 is brought into contact with the mold half 62 so that the first mold comprised of the hub 2 and the fingers 3 is positioned between the two mold halves 61 and 62 with the fingers 3 partly extending into the individual mold cavities defined between the thus combined mold halves 61 and 62. Incidentally, a positioning member 65 may be provided integrally with the finger 3 to keep the finger 3 in position.

Then a molten mold material is injected into the mold cavities from an exterior source through a passage 63. When the injected mold material hardens to form a second mold, or printing section 4, the mold halves 61 and 62 are separated from each other to remove a completed type carrier 1 having a double mold strucuture.

It is to be noted that types provided on the front surfaces of the printing sections 4 formed on the fingers 3 of a type carrier 1 may be different in structure to represent different characters and symbols. Therefore, some types may be simple in structure; whereas, some may be quite complicated. Such difference in structure among types to be provided on the same type carrier may present some problems especially in the step of separating the two mold halves 61 and 62 from each other. For example, those types having a complicated structure tend to remain in the front mold half 61, but those types having a simple structure tend to remain in the back mold half 62. Therefore, the step of separating the mold halves 61 and 62 can be very difficult to carry out and some fingers may be bent excessively during this step thereby destroying the product.

Since types to be provided on the type carrier are usually different in structure, it is preferable if the molded type carrier 1 remains in the back mold half 62 when the two mold halves are separated from each other. However, in manufacturing the present type carriers 1, a tendency for the molded type carrier, especially its printing sections 4, to remain in the back mold half 62 is reduced because sloped portions 42*a* and 42*b* are provided at the back surface of the printing section 4. The sloped portions 42*a* and 42*b* only contribute to increase the tendency to part with the mold half 62.

The present invention, therefore, proposes to provide an irregular or rough portion on a part of the side surface of the printing section 4. As shown in FIG. 26, the printing section 4 has an irregular portion 66 on that part of the side surface which is contacted by the mold recess of the mold half 62. Put it another way, the mold recess of the mold half 62 has an irregular side surface so that when the printing section 4 is formed by injection molding, it will have a corresponding rough portion 66 as shown in FIG. 26. Accordingly, the friction between the mold half 62 and the molded printing section 4 is effectively increased and it is now guaranteed that all of the molded printing sections 4 and, thus, the whole type carrier 1 will remain in the mold half 62 when the mold half 61 is separated therefrom.

It is to be noted that an irregular surface 66 may be provided in any desired manner. For example, a plurality of grooves may be engraved on the side surface of the mold recess. Besides, such an irregular surface 66 may be provided partly on the side surface of the printing section 4.

Figure 27:
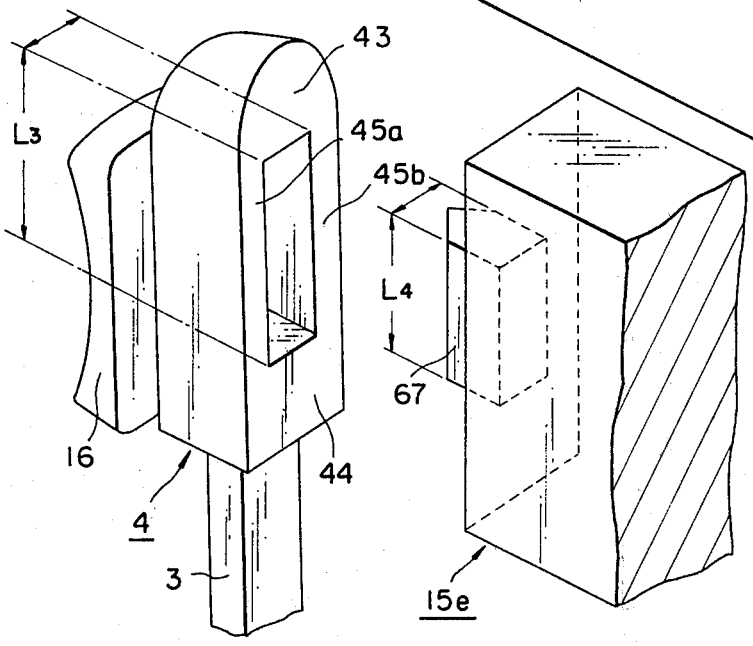
FIG. 27 is a schematic illustration showing a still further embodiment of the present type carrier and its associated detentable hammer.

Finally, FIG. 27 shows a still further embodiment of the present invention in which the sloped portions 42*a* and 42*b* are provided in a different orientation as from the above-described embodiments. Although the sloped portions are not shown in FIG. 27, it should be understood that the bottom of the aligning recess defined in the printing section 4 has sloped portions which are complementary to the "V"-shaped forward end of the aligning projection 67 of the hammer 15*e*. Preferably, the height $L_3$ of the aligning recess is substantially larger than the height $L_4$ of the aligning projection 67. The width of the recess is also preferably larger than the width of the projection 67.

The back surface of the printing section 4 includes the top flat area located generally at the top of the type 16, the bottom flat area located generally at the bottom of the type 16 and a pair of intermediate flat areas 45*a* and 45*b* bridging between the top and bottom flat areas 43 and 44. Thus, the back surface of the printing section 44 presents a relatively large impact surface in outer dimension thereby insuring a uniform distribution of an impacting force. It is to be noted that the aligning projection 67 may be formed only by the "V"-shaped portion without the straight rectangular portion. If so, the aligning recess of the printing section 4 may be formed in the shape of "V".

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A type carrier for use in a printing machine, in which said type carrier is rotatably supported and rotatably driven to bring a desired type into a printing position where said desired type is impacted by a hammer to make an imprint, wherein said type carrier comprises a hub and a plurality of fingers extending generally radially from said hub, at least one of said fingers including a generally rectangularly shaped printing section defined along the lengthwise direction of the corresponding finger, said printing section including a front surface on which at least one type is provided, a first flat impact surface formed at the back surface of said printing section opposite to said front surface and having a relatively large first width extending in the direction perpendicular to the lengthwise direction of said printing section, a second flat impact surface contiguous to and lying in the same plane as said first flat impact surface and having a second width which is narrower than said first width, and a pair of sloped aligning portions extending from opposite edges of said second flat impact surface in the directions generally toward said front surface and separating away from each other and also from the plane defined by said first and second flat impact surfaces.

2. A type carrier of claim 1 wherein said first width substantially corresponds to the full width of said printing section.

3. A type carrier of claim 1 wherein a pair of outer and inner types are provided on the front surface of said printing section with said outer type being located further away from said hub as compared with said inner type along the lengthwise direction of said printing section, and the back surface of said printing section including a pair of outer and inner impacting zones defined in registry with said pair of outer and inner types, respectively, each of said impacting zones including said first and second flat impact surfaces and said pair of sloped aligning portions.

4. A type carrier of claim 3 wherein the plane defined by said first and second flat impact surfaces of said outer impacting zone is inclined to be separated further away from the outer side to the inner side in the radial direction from the plane defined by the motion of said printing section when said type carrier rotates, and the plane defined by said first and second flat impact surfaces of said inner impacting zone is inclined to be separated further away from the inner side to the outer side in the radial direction from the plane defined by the motion of said printing section when said type carrier rotates.

5. A type carrier of claim 3 wherein each of said impacting zones includes a pair of said first flat impact surfaces located near the top and bottom of the corresponding type on the front surface, said second flat impact surface bridging between said pair of first flat impact surfaces, and said pair of sloped aligning portions.

6. A type carrier of claim 5 wherein said second flat impact surface is recessed with respect to said first flat impact surfaces.

7. A type carrier of claim 1 wherein said first flat impact surface is located to cover approximately either one of the top or bottom half of said type provided on said front surface and said second flat impact surface is located to cover approximately the other of the top or bottom half of said type.

8. A type carrier of claim 7 wherein said second flat impact surface is reduced to a ridge.

9. A type carrier of claim 8 wherein said ridge is located below said first flat impact surface.

10. A type carrier of claim 1 wherein said fingers are sufficiently flexible so that said printing section is shiftable with respect to said hub when impacted by a hammer.

11. A type carrier of claim 10 wherein said fingers contain a thermoplastic resin.

12. A type carrier of claim 11 wherein said fingers further contain reinforcing elements.

13. A printing wheel for use in a printing machine, in which said printing wheel is rotatably supported and driven to rotate to bring a desired type into a printing position where said desired type is impacted by a hammer to make an imprint, wherein said printing wheel comprises a hub and a plurality of fingers extending radially from said hub, at least one of said fingers including a generally rectangularly shaped printing section defined along the lengthwise direction of the corresponding finger, said printing section including a front surface on which at least one type is provided, a first flat impact surface formed at the back surface of said printing section opposite to said front surface and having a relatively large first width extending in the direction perpendicular to the lengthwise direction of said printing section, a second flat impact surface contiguous to and lying in the same plane as said first flat impact surface and having a second width which is narrower than said first width, and a pair of sloped aligning portions extending from opposite edges of said second flat impact surface in the directions generally toward said front surface and separating away from each other and also from the plane defined by said first and second flat impact surfaces.

14. A printing wheel of claim 13 wherein said first width substantially corresponds to the full width of said printing section.

* * * * *